US006260789B1

(12) United States Patent
Cramer

(10) Patent No.: US 6,260,789 B1
(45) Date of Patent: Jul. 17, 2001

(54) MULTI-CARRYING-ROLL WINDER

(75) Inventor: Dirk Cramer, Duisbur (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/322,175

(22) Filed: May 28, 1999

(30) Foreign Application Priority Data

Jun. 2, 1998 (DE) ..... 198 24 619

(51) Int. Cl.[7] ..... B65H 18/14; B65H 18/26

(52) U.S. Cl. ..... 242/542.1; 242/530.3; 242/541.5; 242/541.6

(58) Field of Search ..... 242/542.1, 542.4, 242/541.5, 541.6, 530.1, 530.3

(56) References Cited

U.S. PATENT DOCUMENTS

| | | | | |
|---|---|---|---|---|
| 1,984,784 | | 12/1934 | Cameron . | |
| 2,141,629 | | 12/1938 | Warner et al. . | |
| 2,985,398 | | 5/1961 | Rockstrom et al. . | |
| 3,009,666 | | 11/1961 | Moser . | |
| 3,575,357 | * | 4/1971 | Enneking | 242/541.5 X |
| 3,937,410 | * | 2/1976 | Justus | 242/541.5 X |
| 4,026,487 | | 5/1977 | Ales, Jr. . | |
| 4,541,585 | | 9/1985 | Frye et al. . | |
| 4,883,233 | * | 11/1989 | Saukkonen et al. | 242/541.5 X |
| 5,150,850 | * | 9/1992 | Adams | 242/541.5 X |
| 5,190,235 | * | 3/1993 | Schonmeier et al. | 242/541.5 |
| 5,240,198 | * | 8/1993 | Dorfel | 242/542.4 |
| 5,335,871 | * | 8/1994 | Fissmann et al. | 242/542 X |
| 5,386,950 | * | 2/1995 | Abt | 242/541.6 X |
| 5,553,806 | * | 9/1996 | Lucas | 242/542.4 |

FOREIGN PATENT DOCUMENTS

| | | | | |
|---|---|---|---|---|
| 1229361 | | 11/1966 | (DE) . | |
| 4402874 | | 8/1995 | (DE) . | |
| 19636894 | | 3/1998 | (DE) . | |
| 78493 | | 5/1983 | (EP) . | |
| 2087362 | | 5/1982 | (GB) . | |
| 2117935 | | 10/1983 | (GB) . | |
| 55-119653 | * | 9/1980 | (JP) | 242/542.1 |
| 62-264154 | * | 11/1987 | (JP) | 242/541.6 |
| 971756 | * | 11/1982 | (SU) | 242/541.5 |

* cited by examiner

*Primary Examiner*—William A. Rivera
(74) *Attorney, Agent, or Firm*—Greenblum & Bernstein, P.L.C.

(57) ABSTRACT

A multi-carrying-roll winder, and method for winding a material web with a multi-carrying-roll winder. The multi-carrying-roll winder comprises a first carrying roll, a second carrying roll, a loading device, and a controller. The first and second carrying rolls contact a reel upon which a material web is to be wound, such that the first carrying roll is driven to wind the material web onto the reel. An additional loading device contacts a circumference of the reel to additionally drive the reel. A controller adjusts an amount of driving power applied to the reel by each of the first carrying roll, the second carrying roll and the additional loading device.

26 Claims, 2 Drawing Sheets

MULTI-CARRYING-ROLL WINDER

CROSS-REFERENCE TO RELATED APPLICATIONS

The present application claims priority under 35 U.S.C. §119 of German Patent Application No. 198 24 619.6, filed on Jun. 2, 1998, the disclosure of which is expressly incorporated by reference herein in its entirety.

BACKGROUND OF THE INVENTION

1. Field of The Invention

The present invention is directed to a multi carrying-roll winder having a first driven carrying roll and a second driven carrying roll, that forms a winding bed, and a loading device.

2. Discussion of Background Information

Multi-carrying-roll winders (e.g., a winder with two or more carrying rolls) are often used in connection with a roll cutter to wind up web sections that have been longitudinally cut by the roll cutter from a material web, so as to form reels.

Such multi-carrying-roll winders have a particularly large field of application in the manufacture of paper webs. Paper webs are typically manufactured in widths of up to 10 m. However, users, such as, for example, print shops, normally require paper web widths of approximately 0.8 to 3.8 m.

Multiple rolls can be wound near each other, so that they have a common winding axis. In such a situation, the sum of the axial lengths of the winding rolls corresponds to the width of the original paper web. The same is true for other material webs, such as, for example, plastic films or metal foils.

In contrast to support roll winders, in which individual reels are wound offset, relative to each other, it is normally not possible to support the reels on a core, or to introduce torques at the reels with dual-carrying-roll winders. In particular, when the rolls are very wide, problems arise with controlling roll hardness.

The reels are supposed to be structured such that they have a relatively high hardness in the region of their core. That is, in the core region, the paper (or other material web) is intended to be firmly wound. The hardness in the central region is supposed to be somewhat less and remain constant (or decrease) from the inside of the reel towards the outside of the reel.

With multi-carrying-roll winders, the production of the hard core region presents difficulties. If the core is not hard enough, core sags can occur in wide rolls. An attempt has been made to solve this problem by pressing the roll core into the winding bed. That is, the roll core is pressed against the carrying rolls with a relatively high force at the beginning of the winding process. The carrying rolls are driven with different torques, such that a web tension is "wound into" the reel. However, if the pressure is too great, other problems, such as, for example, a layer shift, may occur.

SUMMARY OF THE INVENTION

It is, therefore, an object of the present invention to provide an additional influencing capability to control roll hardness.

According to the present invention, a dual-carrying-roll winder includes an additional drive device that acts on the circumference of the reel to control a roll hardness.

The additional drive device functions to assist the two carrying rolls to drive the reel. This arrangement permits a greater driving power to be transferred to the reel than is possible in the prior art devices. Driving power refers to the rate (in kilowatts) of transferring energy from, for example, a drive, to, for example, a carrying roll.

Increasing the amount of driving power to the reel has not been possible, prior to the development of the present invention, because, for example, it has not been possible to prevent slippage against the reel when an excessively high drive torque is applied. In particular, when the winding process begins (e.g., the reel comprises a core with perhaps, a few material web layers wound thereon), the winding power that can be transferred from the carrying rolls to the reel is limited.

It is desirable to set different driving powers for the first carrying roll and the second carrying roll, in, for example, a dual-carrying-roll-winder, in order to create a desired web tension in the reel. However, it has not been possible to apply a full driving power (e.g., 100% of the torque generated by an associated driving device) to each carrying roll of a dual-carrying-roll winder. Rather, the sum of the driving power that can be applied to two carry rolls has generally been only slightly more that the driving power that could be applied to a single carrying roll winder. This problem is overcome, in the current embodiment, by the inclusion of an additional drive device. As a result, it is now possible to apply greater drive torques to the reel, increasing the web tension, especially at the beginning of the winding process.

The procedure for designing a loading device as a loading roll and for driving it is known in the art. However, such prior art systems have not been useable for driving a reel. Instead, such systems have traditionally been used only to provide a flywheel effect, in order to prevent the reel from having to also turn the loading roll.

On the other hand, the current invention discloses a driving device that actually acts upon the reel to drive it.

According to a preferred embodiment of the invention, the additional drive device supplies, at least in a winding section at the beginning of a winding operation, at least approximately 15% (and preferably approximately 20%), of the drive power to the reel. This is a significant increase in the amount of drive power (torque) transferred to the reel, as compared to the prior art devices.

In the preferred embodiment, the drive device contacts the reel with a contact pressure distribution that is directed towards the winding bed. The drive device is also used to hold the reel in the winding bed and to press it against the carrying rolls. An improved frictional grip is achieved between the reel and the carrying rolls, so as to increase the amount of driving power (torque) transferred from the carrying rolls to the circumference of the reel.

The present invention is realized using a simple design, in which the drive device is formed by a loading device. Thus, two functions are combined in the loading device. First, a contact pressure is applied to the reel, which is necessary (at least at the beginning of the winding operation) to generate the necessary nip pressures on the carrying rolls for the winding process. Second, the application of additional drive power significantly increases the ability to control a web tension, and thus, control the winding hardness.

Preferably, the drive device applies a greater portion (e.g., percentage) of the total driving power (e.g., torque) to the winding roll than to the first carrying roll in a predetermined winding section of the winding process. As noted above, it is desirable (in many cases) to apply differing driving powers to the first carrying roll and the second carrying roll. In the current invention, more power (torque) is (at least initially) applied to the second carrying roll, as compared to the first carrying roll. In this regard, as discussed above, the inclusion of the additional drive device permits a greater amount of driving power (torque) to be applied to the carrying rolls. Thus, the reel can be rotated with a relatively high torque.

In this regard, it is noted that the torque is not applied in the first nip (e.g., the location between the first carrying roll and the reel). Rather, an increased web tension is generated immediately behind the nip. As a result, the web tension can be "wound into" the reel, producing the desired winding hardness.

In the preferred embodiment, the predefined winding section amounts to at least 40% of the final diameter of the reel. However, this percentage can vary without departing from the scope and/or spirit of the invention. As the diameter of the reel increases, the proportion of driving power (torque) applied to the reel by the first carrying roll increases. As a result, the winding hardness decreases as the reel diameter increases.

In the current invention, a control device operates to distribute the amount of driving power between the two carrying rolls and the additional drive device. As a result, it is possible to operate specific sequences depending upon the manner in which the driving power is to be distributed. For example, a driving power distribution can be used in which, at the beginning of the winding process, approximately 10% of the total driving power (torque) is applied by the first carrying roll, approximately 40% of the total driving power (torque) is applied by the second carrying roll, and approximately 50% of the total driving power (torque) is applied by t he additional drive device. When the diameter of the reel becomes approximately 500 mm, the driving power proportions of modified, so that, for example, the amount of driving power applied by the second carrying roll and the drive device are exchanged (e.g., approximately 40% of the total driving power is applied by the first carrying roll and approximately 10% of the total driving power is applied by the second carrying roll).

When the diameter of the reel increases to approximately 1000 mm, the amount of driving power applied by the additional drive device may, for example, be decreased to 0. The amount of driving power applied to the reel by the first carrying roll is approximately 30% of the total driving power and the amount of driving power applied to the reel by the second carrying roll is approximately 70% of the total driving power.

When the winding process nears its completion (for example, when the diameter of the reel is approximately 1500 mm), the amount of driving power applied to the reel by the first carrying roll is changed to approximately 45% of the total driving power. In a similar manner, the amount of driving power applied to the reel by the second carrying roll is set to approximately 55% of the total driving power.

Of course, it is understood that other power distribution ratios may be used without departing from the spirit and/or scope of the invention.

In the current invention, the amount of driving power (torque) applied to the reel by the additional drive device decreases and the amount of driving power applied to the reel by the first carrying roll increases, when the diameter of the reel reaches a predetermined diameter. As a result, a desired winding hardness pattern, in which the winding hardness decreases from an inside of the reel towards an outside of the reel, is obtained.

In the current invention, the additional loading device comprises a loading roll having an elastic surface. That is, the surface of the loading device is, within certain limits, flexible (compressible). When the loading roll is pressed against the reel, the pliability (compressibility) of the loading device results in the formation of an increased contact region between the reel and the loading roll. As a result, despite a predefined line load, the compressive stress can be maintained within desired limits. Thus, the material web is protected from unwanted damage.

Further, the compressibility of the surface of the loading device means that the additional drive device acts on the reel over a correspondingly larger circumferential section, such that the contact surface for the transfer of torque becomes larger, and thus, more effective.

The design of the current invention is desirable when a common loading roll is provided for use with a plurality of reels. The compressibility (flexibility) of the surface of the loading roll ensures that the loading roll contacts each of the multiple reels, despite any small differences that may exist with respect to the diameters of each reel. The current invention compensates for the different diameters of the plural reels (e.g., minute variations in the diameters of the multiple reels) that may exist, due to, for example, manufacturing tolerances. By using an elastic loading roll, the density and the diameter of the individual reels may be kept, within certain limits, the same. This produces a self-controlling winding effect. That is, the larger diameter reels penetrate farther into the elastic surface of the loading roll. The compressive stress thus becomes greater, inhibiting an increase in the diameter of the loading roll in comparison with the smaller diameter reels, and which thus, do not penetrate as far into the elastic surface of the loading roll. The increase in diameter of the loading roll takes place quickly, such that the diameters are quickly equalized. Overall, this produces a relatively uniform increase in the diameter for each reel during the winding process.

According to an object of the invention, a multi-carrying roll winder comprises a winding bed in which a winding reel is located. The winding bed comprises a first driven carrying roll, and a second driven carrying roll. Further, an additional drive device is provided that acts on a circumference of the winding reel to drive the winding reel. The additional drive device may include a loading roll.

In one advantage of the invention, the additional drive device applies at least approximately 15% of a total driving power to the winding reel at the start of a winding operation. In a variation of the invention, the additional drive device applies at least approximately 20% of the total driving power to the winding reel at the start of a winding operation.

According to another advantageous embodiment of the current invention, the driving power is applied with a contact force distribution on the winding reel, whose resultant force is directed toward the winding bed.

Advantageously, the driving power (torque) applied to the reel by the loading reel (e.g., additional drive device) exceeds the driving power (torque) applied to the reel by the first carrying roll, during at least a predefined section (e.g., diameter of the reel upon which the material web is being wound) of the winding operation. In the preferred embodiment of the invention, the predefined section is defined as being when the diameter of the reel, upon which the material web is being wound, is approximately 0% to approximately 40% of a final diameter of the reel.

According to a feature of the invention, a control device is provided that controls the amount of driving power (torque) applied to the reel by each of the first driven carrying roll, the second driven carrying roll, and the additional drive device. The amount of torque (driving power) applied to the reel by the additional drive device decreases, and the driving power applied to the reel by the first carrying roll increases, when a diameter of the winding roll reaches a predefined diameter.

According to another feature of the invention, the loading roll includes an elastic surface.

In another advantage of the instant invention, the winding reel comprises a plurality of reels that are axially arranged, one after another, in the winding bed, and the loading roll is provided in common with the plurality of reels. The surface of the loading roll is compressible (pliable), so as to ensure contact with each of the plurality of reels.

According to another object of the invention, a multi-carrying roll winder comprises a first carrying roll, a second carrying roll, a loading device, and a controller. The first carrying roll contacts a reel, upon which a material web is to be wound, so as to wind the material web onto the reel. The second carrying roll also contacts the reel, and is also driven to wind the material web onto the reel. The loading device assists in the winding operation by contacting a circumference of the reel. The controller controls the amount of driving power (torque) applied to the reel by each of the first carrying roll, the second carrying roll and the loading device. The reel may comprise a single reel, or, alternatively, a plurality of reels that are positioned in an axial arrangement.

An elastic coating may be formed on a surface of the loading device. The elastic coating compensates for diameter variations among the plurality of reels.

A still further advantage of the invention is that the loading device applies the majority of driving power (e.g., majority of torque) to the reel when the diameter of the reel is less than a first predetermined value (e.g., for example, less than approximately 102 mm). The first carrying roll applies the majority of driving power to the reel when the diameter of the reel is greater than a second predetermined value (e.g., for example, greater than approximately 500 mm). In this regard, the driving power applied by the loading device to the reel is reduced as the diameter of the reel increases. In the disclosed embodiment of the invention, the amount of driving power applied to the reel by the loading device is reduced to substantially zero when the diameter of the reel reaches a certain diameter (e.g., for example, 1000 mm). In the disclosed embodiment, the amount of driving power applied to the reel by the loading device decreases, and the amount of driving power applied to the reel by the first carrying roll, increases as a diameter of the reel increases from an initial diameter to a predefined diameter.

According to another object of the invention, a method is disclosed for winding a material web. The method comprises loading a winding reel, upon which a material web is wound, onto a winding bed. The winding reel is driven by a first carrying roll, a second carrying roll, and an additional drive device. The additional drive device acts upon a circumference of the winding reel. An amount of driving power applied to the winding reel by each of the first carrying roll, the second carrying roll and the additional drive device is controlled, in order to obtain a desired winding hardness.

The amount driving power applied to the reel by each of the first carrying roll, the second carrying roll and the additional drive device may be controlled in accordance with a diameter of the winding reel.

BRIEF DESCRIPTION OF THE DRAWINGS

The present invention will be further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of an example and for purposes of illustrative discussion of the present invention only and are presented in the course of providing what is believed to be the most useful and readily understood description of the principles and conceptual aspects of the present invention. In this regard, no attempt is made to show structural details of the present invention in more detail than is necessary for the fundamental understanding of the instant invention, the description taken with the drawings making apparent to those skilled in the art how the several forms of the present invention may be embodied in practice.

Further, while the present description is provided with respect to a dual-carrying-roll winder, it is understood that the invention is applicable to any multi-carrying-roll winder.

Figure 1:
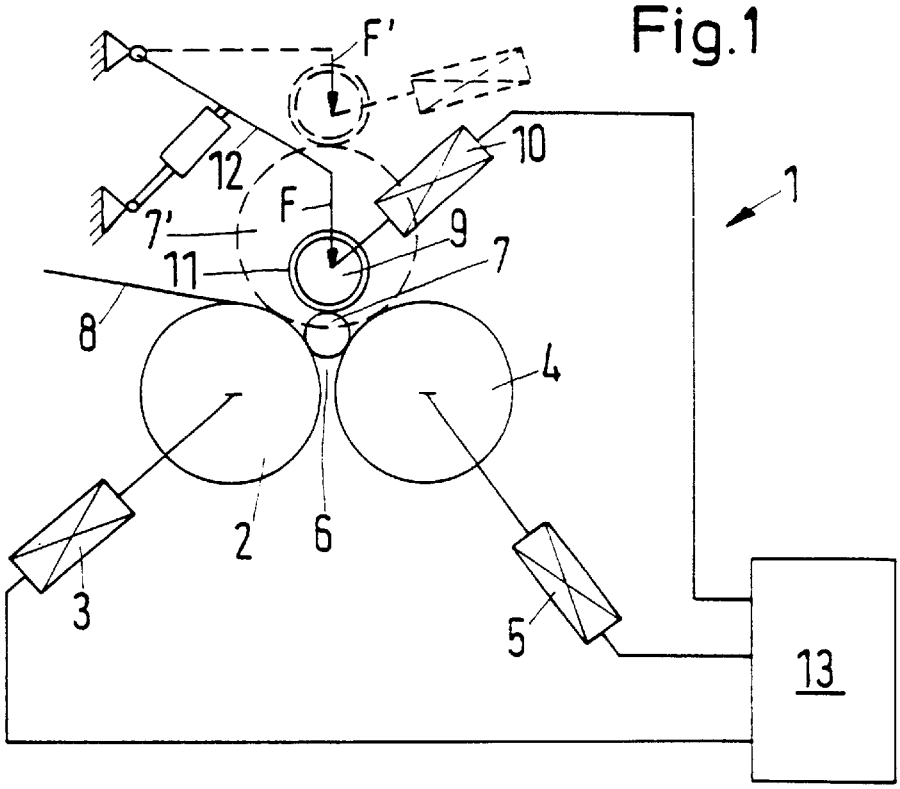
FIG. 1 is a side view illustration of a winding device of the current invention.

A winding device 1 is schematically illustrated in FIG. 1. The winding device 1 includes a first carrying roll 2 having a first associated drive 3, and a second carrying roll 4 having a second associated drive 5. A winding bed 6, in which a reel 7 is disposed, is formed between the first and second carrying rolls 2 and 4. Reel 7 is depicted (in FIG. 1) by a solid line at the start (e.g., beginning) of a winding operation. At the start of the winding operation, the diameter of the reel 7 comprises only a core having a diameter of, for example, approximately 100 mm. However, it is understood that different size cores can be used without departing from the spirit and/or scope of the invention.

A web 8, such as, for example, a paper web, is wound onto the core of the reel 7. In the preferred embodiment, a paper web 8 is disposed between the core 7 and the first carrying roll 2. However, it is understood that other type webs and/or web paths are possible without departing from the spirit and/or scope of the invention. For example, the paper web may be fed into the winding bed 6 from a bottom, between the first and second carrying rolls 2 and 4, with a nip formed between the carrying roll 2 and the reel 7. As the web 8 is wound onto the core of the reel 7, the diameter of the reel 7 increases, as illustrated in FIG. 1 by a dotted line denoted by element 7'.

A loading roll 9 is provided to act on the reel 7. An additional drive 10 functions to drive (rotate) the loading roll 9. In the disclosed embodiment, the additional drive 10 is interfaced to one axial end of the loading roll 9, or, alternatively, to both axial ends of the loading roll 9. However, other interfacing methods may be employed without departing from the spirit and/or scope of the invention.

In the instant invention, an elastic layer 11 is formed on a circumference (e.g., outermost surface) of the loading roll 9. Leverage 12, applied to the loading roll 9, exerts a force F on the loading roll 9 in the direction shown by an arrow in FIG. 1. The force F acts upon the loading roll 9 in a direction of the winding bed 6.

As the web 8 is wound on the reel 7, the diameter of the reel 7 increases, as represented by 7' in FIG. 1. As the diameter of the reel increases, the loading roll 9 moves away from the winding bed 6, as depicted by dotted lines in FIG. 1.

Drives 3, 5 and 10 are connected to a controller 13. The controller 13 adjusts (controls) the distribution of driving power between the drives 3, 5 and 10.

Figure 3:
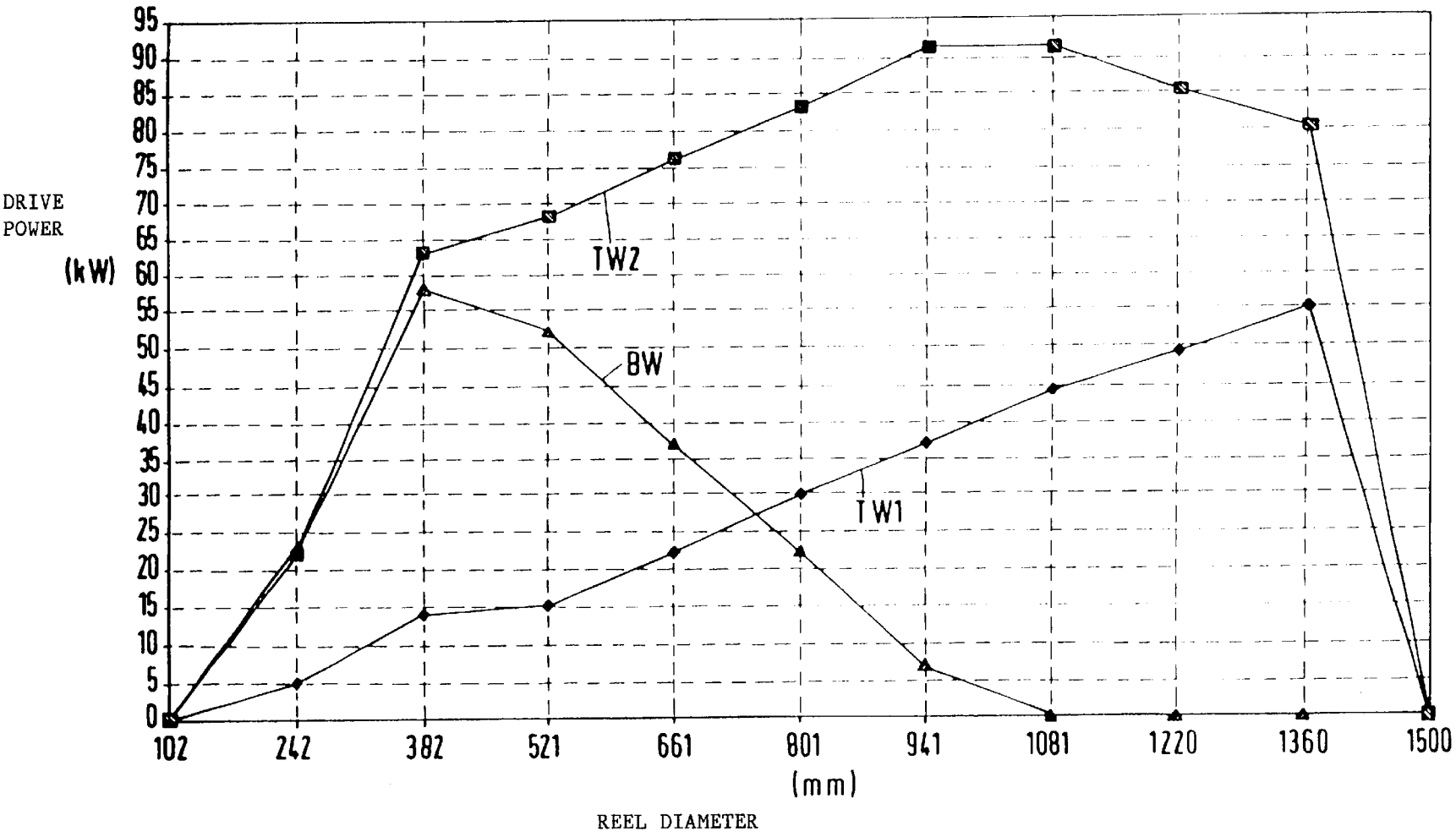
FIG. 3 is a graphic representation of a winding power distribution of the invention of FIG. 1.

The distribution of driving power is schematically illustrated in FIG. 3. Curve TW1 represents a change in driving power applied to the reel by the first carrying roll 2 as the size of the reel, upon which the web 8 is wound, increases from an initial diameter (represented in FIG. 1 by reel 7) to a final diameter (represented in FIG. 1 by reel 7'). Curve TW2 represents a change in driving power applied to the reel by the second carrying roll 4 as the size of the reel, upon which the web 8 is wound, increases from the initial diameter to the final diameter. Curve BW represents a change in driving power applied to the reel by the loading roll 9 as the size of the reel, upon which the web 8 is wound, increases from the initial diameter to the final diameter.

As shown in FIG. 3, when a winding operation begins (starts), the driving power is primarily applied to the reel by the second carrying roll 4 and the loading roll 9, and the first carrying roll 2 contributes only a small amount of driving power to the overall driving of the reel. It is noted that in the disclosed embodiment, the amount of driving power contributed by the loading roll 9 to rotate the reel 7 is initially greater than the amount of driving power contributed by the second carrying roll 4 to rotate the reel 7.

A breakdown of the driving power distribution (as a percentage of a total amount of torque that can be applied to the reel) between the first carrying roll 2, the second carrying roll 4 and the loading roll 9 is shown in the following Table:

| Diameter | Proportion Carrying Roll 2 | Proportion Loading Roll | Proportion Carrying Roll 1 |
|---|---|---|---|
| 102 mm | 40% | 50% | 10% |
| 500 mm | 50% | 40% | 10% |
| 1000 mm | 70% | 0% | 30% |
| 1500 mm | 55% | 0% | 45% |

According to the above Table, when the winding operation begins (e.g., a material web is wound onto a substantially empty reel), the percentage of driving power (torque) applied to the reel by the loading roll 9 is greater than the percentage of driving power applied to the reel by the second carrying roll 4. When the diameter of the reel increases to be between approximately 500 and 1000 mm, the percentage of driving power applied to the reel by the loading roll 9 decreases from approximately 40% to approximately 0%.

As the material web 8 is wound onto the reel 7, the diameter of the reel increases, along with the weight of the reel/material web combination. As a result, the amount of driving power applied to the reel by the loading roll 9 is reduced when the reel reaches a certain reel diameter, such as, for example, 500 mm.

When the diameter of the reel becomes approximately 1000 mm, the force of the loading roll 9 on the reel 7' is reduced to a minimum. In the preferred embodiment, the amount of driving power applied to the reel by the loading roll is reduced to substantially 0. Accordingly, the loading roll 9 no longer exerts a driving force on the reel.

The instant invention discloses that it is desirable to have the first carrying roll 2 and the second carrying roll 4 apply different of driving powers (torques) to the reel, in order to create a tension in the web 8 that is wound onto the reel. However, it is possible to have the first carry roll 2 and the second carrying roll 4 apply the same amount of driving power (torque) to the reel.

In the disclosed embodiment, the amount of driving power applied to the reel by the first carrying roll 2 increases as the diameter of the reel increases, until the amount of driving power applied to the reel by the first carrying roll 2 reaches a maximum of approximately 45% of the total available driving power (torque). In the disclosed embodiment, this occurs when the diameter of the reel is approximately 1500 mm.

Similarly, the amount of driving power applied to the reel by the second carrying roll 4 decreases as the diameter of the reel increases, until the amount of driving power reaches a minimum of approximately 55% of the total available driving power. In the instant invention, this occurs when the diameter of the reel is approximately 1500 mm.

Of course, it is understood that variations in the amount of driving power (proportions) and/or points at which such driving power amounts change may be varied without departing from the spirit and/or scope of the invention.

It is also noted that the decreasing force exerted by the loading roll 9, as the reel diameter increases, is represented in FIG. 1 by a smaller arrow F'.

The elastic coating 11 provided on the loading roll 9 affords several benefits. In particular, the elastic coating 11 increases the contact surface between the loading roll 9 and the reel 7. As a result, the torque is more effectively transferred to the reel 7.

Another benefit provided by the elastic coating on the loading roll 9 will now be discussed with respect to FIG. 2 of the drawings. As shown in Pig. 2, reel 7 comprises a plurality of reels (e.g., three reels 7A, 7B, and 7C), that lie on the first carrying roll 2. The second carrying roll 4 is not illustrated in FIG. 2.

Although web 8 is wound from a web section cut from the same material web as the web sections of reels 7A and 7C, the diameter of reel 7B is somewhat smaller than the diameter of reels 7A and 7C. The smaller diameter of reel 7B, in comparison with reels 7A and 7C, is illustrated, in an exaggerated manner, in FIG. 2.

Figure 2:
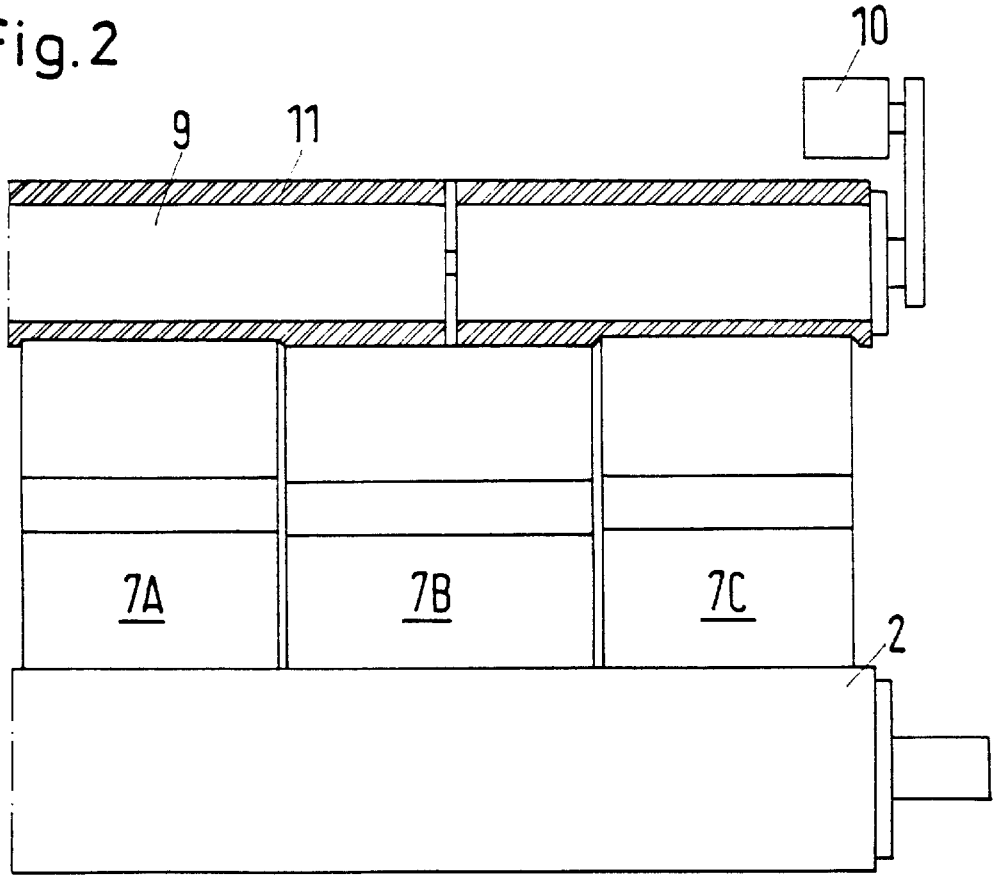
FIG. 2 a schematic front view of the invention of FIG. 1, with a partial cut-away view.

As shown in FIG. 2, the elastic coating 11 on the loading roll 9 is more highly compressed in the region of reels 7A and 7C. Larger diameter reels 7A and 7C exert a greater amount of compression of the elastic coating on the loading roll 9 as compared to smaller diameter reel 7B. The diameter of reel 7B will adjust to be the same diameter as the adjacent reels 7A and 7C in a relatively short time. Thus, a self-regulating winding effect is achieved. As a result, the multiple reels 7A–7C, which are axially disposed one after another, can be simultaneously wound.

It is noted that the foregoing example has been provided merely for the purpose of explanation, and in no way is to be construed as limiting the present invention.

While the present invention has been described with reference to an exemplary embodiment, it is understood that the words which have been used herein are words of description and illustration, rather than words of limitation. Changes may be made, within the purview of the appended claims, as presently stated and as amended, without departing from the scope and/or spirit of the instant invention in its aspects. Although the present invention has been described herein with reference to particular means, materials and embodiments, the present invention extends to all functionally equivalent structures, methods and uses, such as are within the scope of the appended claims.

What is claim is:

1. A multi-carrying roll winder, comprising a winding bed in which a winding reel is located, said winding bed comprising:

a first driven carrying roll;

a second driven carrying roll; and an additional drive device, having an outer elastic coating, that acts on a circumference of said winding reel to drive said winding reel;

wherein said additional drive is initially powered by a majority of total driving power applied to the winding reel, and, as the diameter of the winding reel increases, the driving power of said first and second carrying rolls increases to a majority of the total driving power applied to the winding reel, whereby the driving power of said additional drive decreases to a minority of the total driving power.

2. The winder of claim 1, wherein said additional drive device applies a driving power of at least approximately 15%, of a total driving power, to the winding reel at a start of a winding operation.

3. The winding of claim 1, wherein said additional drive device applies a driving power of at least approximately 20%, of a total driving power, to the winding reel at a start of a winding operation.

4. The winder of claim 1, wherein said additional drive device includes a loading roll.

5. The winder of claim 4, wherein said winding reel comprises a plurality of reels arranged axially, one after another, in said winding bed, said loading roll being provided in common with said plurality of reels, said elastic coating of said loading roll ensuring contact with each of said plurality of reels.

6. The winder of claim 1, wherein an amount of driving power applied to said winding reel by said second driven carrying roll is greater than said amount of driving power applied to said winding reel by said first driven carrying roll during at least a predefined section of a winding operation.

7. The winder of claim 6, wherein said predefined section comprises at least 40% of a final diameter of said winding reel.

8. The winder of claim 1, further comprising a control device that controls an amount of driving power applied to the winding reel by each of said first driven carrying roll, said second driven carrying roll, and said additional drive device.

9. The winder of claim 8, wherein said amount of driving power applied to said winding reel by said additional drive device decreases and said amount of driving power applied to said winding reel by said first driven carrying roll increases when a diameter of said winding roll reaches a predefined diameter.

10. The winder of claim 1, wherein said driving power is applied with a contact force distribution on said winder reel, such that a resultant force is directed toward said winding bed.

11. A multi-carrying roll winder, comprising:

a first carrying roll, said first carrying roll contacting a reel upon which a material web is to be wound, said first carrying roll being driven to wind the material web onto the reel;

a second carrying roll, said second carrying roll contacting the reel, said second roll being driven to wind the material web onto the reel;

a loading device, having an outer elastic coating, that contacts a circumference of the reel to drive the reel; and a controller that adjusts an amount of driving power applied to the reel by each of said first carrying roll said second carrying roll and said loading device;

wherein said additional drive is initially powered by a majority of total driving power applied to the winding reel, and, as the diameter of the winding reel increases, the driving power of said first and second carrying rolls increases to a majority of the total driving power applied to the winding reel, whereby the driving power of said additional drive decreases to a minority of the total driving power.

12. The winder of claim 11, wherein the reel comprises a plurality of reels positioned in an axial arrangement.

13. The winder of claim 12, wherein said elastic coating formed on a surface of said loading device compensates for diameter variations among said plurality of reels.

14. The winder of claim 11, wherein a majority of said driving power is applied to drive the reel by said loading device when a diameter of the reel is less than a first predetermined value.

15. The winder of claim 14, wherein a majority of said driving power is applied to drive the reel by said first carrying roll when a diameter of the reel is greater than a second predetermined value.

16. The winder of claim 15, wherein said amount of said driving power applied to the reel by said loading device is reduced as the diameter of the reel increases.

17. The winder of claim 16, wherein said amount of said driving power applied to the reel by said loading device is reduced to substantially zero when the diameter of the reel reaches a certain diameter.

18. The winder of claim 17, wherein said amount of said driving power applied to the reel by said loading device decreases and said amount of said driving power applied to the reel by said first carrying roll increases as the diameter of the reel increases from an initial diameter to a predefined diameter.

19. The winder of claim 17, wherein said first predetermined diameter comprises a reel diameter of approximately 102 mm, said second predetermined diameter comprises a reel diameter of approximately 500 mm, and said certain diameter comprises a reel diameter of approximately 1000 mm.

20. The winder of claim 11, wherein said amount of said driving power applied to the reel by said loading device decreases and said amount of said driving power applied to the reel by said first carrying roll increases as a diameter of the reel increases from an initial diameter to a predefined diameter.

21. A method for winding a material web, comprising:

loading a winding reel onto a winding bed, the material web being wound on the winding reel;

driving the winding reel with a first carrying roll associated with the winding bed;

driving the winding reel with a second carrying roll associated with the winding bed;

driving the winding reel with an additional drive device, having an outer elastic coating, that acts upon a circumference of the winding reel; and controlling an amount of driving power applied to the winding reel by each of the first carrying roll, the second carrying roll and the additional drive device;

wherein said additional drive is initially powered by a majority of total driving power applied to the winding reel, and, as the diameter of the winding reel increases, the driving power of said first and second carrying rolls increases to a majority of the total driving power applied to the winding reel, whereby the driving power of said additional drive decreases to a minority of the total driving power.

22. The method of claim 21, wherein controlling the driving power comprises adjusting the amount of driving power applied to the winding reel by each of the first carrying roll, the second carrying roll and the additional drive device in accordance with a diameter of the winding reel.

23. A multi-carrying roll winder, comprising a winding bed in which a winding reel is located, said winding bed comprising:

a first driven carrying roll;

a second driven carrying roll; and an additional drive device that acts on a circumference of said winding reel to drive said winding reel;

wherein said first and second driven carrying roll and additional drive device can be controlled independently of one another;

wherein said additional drive device applies a driving power of at least approximately 15%, of total driving power, to the winding reel at a start of a winding operation;

wherein an amount of driving power applied to said winding reel by said second driven carrying roll is greater than said amount of driving power applied to said winding reel by said first driven carrying roll during at least a predefined section of a winding operation;

wherein said amount of driving power applied to said winding reel by said additional drive device decreases and said amount of driving power applied to said winding reel by said first driven carrying roll increases when a diameter of said winding roll reaches a predefined diameter.

24. A multi-carrying roll winder, comprising a winding bed in which a winding reel is located, said winding bed comprising:

a first driven carrying roll;

a second driven carrying roll; and an additional drive device that acts on a circumference of said winding reel to drive said winding reel;

wherein said additional drive is initially powered by a majority of total driving power applied to the winding reel, and, as the diameter of the winding reel increases, the driving power of said first and second carrying rolls increases to a majority of the total driving power applied to the winding reel, whereby the driving power of said additional drive decreases to a minority of the total driving power.

25. A multi-carrying roll winder, comprising:

a first carrying roll, said first carrying roll contacting a reel upon which a material web is to be wound, said first carrying roll being driven to wind the material web onto the reel;

a second carrying roll, said second carrying roll contacting the reel, said second roll being driven to wind the material web onto the reel;

a loading device that contacts a circumference of the reel to drive the reel; and a controller that adjusts an amount of driving power applied to the reel by each of said first carrying roll said second carrying roll and said loading device;

wherein said additional drive is initially powered by a majority of total driving power applied to the winding reel, and, as the diameter of the winding reel increases, the driving power of said first and second carrying rolls increases to a majority of the total driving power applied to the winding reel, whereby the driving power of said additional drive decreases to a minority of the total driving power.

26. A method for winding a material web, comprising:

loading a winding reel onto a winding bed, the material web being wound on the winding reel;

driving the winding reel with a first carrying roll associated with the winding bed;

driving the winding reel with a second carrying roll associated with the winding bed;

driving the winding reel with an additional drive device that acts upon a circumference of the winding reel; and controlling an amount of driving power applied to the winding reel by each of the first carrying roll, the second carrying roll and the additional drive device, wherein said additional drive is initially powered by a majority of total driving power applied to the winding reel, and, as the diameter of the winding reel increases, the driving power of said first and second carrying rolls increases to a majority of the total driving power applied to the winding reel, whereby the driving power of said additional drive decreases to a minority of the total driving power.

* * * * *